US008995847B2

(12) United States Patent
Itabashi

(10) Patent No.: US 8,995,847 B2
(45) Date of Patent: Mar. 31, 2015

(54) CARTRIDGE AND IMAGE FORMING APPARATUS PROVIDED THEREWITH

(71) Applicant: Nao Itabashi, Nagoya (JP)

(72) Inventor: Nao Itabashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 112 days.

(21) Appl. No.: 13/719,650

(22) Filed: Dec. 19, 2012

(65) Prior Publication Data

US 2013/0170845 A1 Jul. 4, 2013

(30) Foreign Application Priority Data

Dec. 28, 2011 (JP) ..... 2011-288491

(51) Int. Cl.

| | |
|---|---|
| ***G03G 15/00*** | (2006.01) |
| ***G03G 15/08*** | (2006.01) |
| ***G03G 21/16*** | (2006.01) |
| *G03G 21/18* | (2006.01) |

(52) U.S. Cl.

CPC ..... *G03G 15/757* (2013.01); *G03G 21/1857* (2013.01); *G03G 15/0863* (2013.01); *G03G 21/1647* (2013.01); *G03G 15/0886* (2013.01); *G03G 21/1676* (2013.01)

USPC ..... 399/12

(58) Field of Classification Search

CPC ..... G03G 15/757; G03G 15/0863; G03G 15/0886; G03G 21/1676; G03G 21/1647; G03G 21/1857

USPC ..... 399/12

See application file for complete search history.

(56) References Cited

U.S. PATENT DOCUMENTS

| | | | |
|---|---|---|---|
| 7,409,167 | B2 | 8/2008 | Inukai |
| 7,512,347 | B2 | 3/2009 | Suzuki et al. |
| 7,953,330 | B2 | 5/2011 | Ishikawa |
| 7,970,293 | B2 | 6/2011 | Ishikawa et al. |

(Continued)

FOREIGN PATENT DOCUMENTS

| | | | |
|---|---|---|---|
| CN | 1734361 | A | 2/2006 |
| CN | 200962188 | Y | 10/2007 |

(Continued)

OTHER PUBLICATIONS

CN Notification of the First Office Action mailed Jul. 3, 2014, CN Appln. 201210558762.4, English translation.

(Continued)

*Primary Examiner* — David Gray
*Assistant Examiner* — Tyler Hardman
(74) *Attorney, Agent, or Firm* — Banner & Witcoff, Ltd.

(57) ABSTRACT

A cartridge includes: a frame; a rotation body; a driving force transmission unit; a closing member; and a moving member. The frame is formed with a filling port for filling an internal space of the cartridge with a developing agent therethrough. The closing member is configured to close the filling port. The moving member is configured to be irreversibly moved to one of a covered position and an exposed position by an external driving force transmitted through the driving force transmission unit. The moving member covers at least a portion of the closing member when the moving member is at the covered position. The moving member exposes the closing member when the moving member is at the exposed position. The exposed position provides an exposing degree greater than that at the covered position.

21 Claims, 11 Drawing Sheets

(56) References Cited

U.S. PATENT DOCUMENTS

| | | | | |
|---|---|---|---|---|
| 8,090,272 | B2 | 1/2012 | Ishikawa | |
| 8,548,339 | B2 | 10/2013 | Ishikawa | |
| 8,805,210 | B2 | 8/2014 | Mushika | |
| 2003/0185579 | A1 | 10/2003 | Nishino et al. | |
| 2005/0031359 | A1* | 2/2005 | Ishii | 399/12 |
| 2006/0034623 | A1 | 2/2006 | Inukai | |
| 2006/0034625 | A1 | 2/2006 | Kajikawa | |
| 2006/0140652 | A1* | 6/2006 | Itabashi | 399/27 |
| 2006/0193646 | A1* | 8/2006 | Suzuki et al. | 399/12 |
| 2007/0122165 | A1 | 5/2007 | Igarashi et al. | |
| 2008/0205911 | A1 | 8/2008 | Ishikawa et al. | |
| 2008/0205928 | A1 | 8/2008 | Ishikawa | |
| 2008/0223173 | A1 | 9/2008 | Ishikawa | |
| 2011/0211864 | A1 | 9/2011 | Ishikawa | |
| 2011/0211866 | A1 | 9/2011 | Hashimoto | |
| 2012/0251216 | A1 | 10/2012 | Mushika | |
| 2013/0170844 | A1* | 7/2013 | Itabashi | 399/12 |
| 2013/0236197 | A1* | 9/2013 | Yoshida et al. | 399/12 |

FOREIGN PATENT DOCUMENTS

| | | | |
|---|---|---|---|
| EP | 1674944 | A2 | 6/2006 |
| EP | 1950625 | A2 | 7/2008 |
| EP | 2506087 | A1 | 10/2012 |
| JP | H08-146739 | A | 6/1996 |
| JP | H08-305244 | A | 11/1996 |
| JP | 2000-047549 | A | 2/2000 |
| JP | 2000-098725 | | 4/2000 |
| JP | 2000098725 | A * | 4/2000 |
| JP | 2002-006605 | | 1/2002 |
| JP | 2003-316227 | A | 11/2003 |
| JP | 2006-267994 | | 10/2006 |
| JP | 2006-308928 | A | 11/2006 |
| JP | 4023130 | B2 | 12/2007 |
| JP | 2008-216392 | A | 9/2008 |

OTHER PUBLICATIONS

CN Notification of the First Office Action mailed Jun. 30, 2014 issued in CN Application No. 201210558753.5, English translation.

Sep. 2, 2014—(US) Non-Final Office Action—U.S. Appl. No. 13/719,417.

Oct. 28, 2014—(EP) Extended Search Report—App 12197692.2.

Oct. 31, 2014—(EP) Extended Search Report—App 12197681.5.

Jan. 22, 2015—(US) Notice of Allowance—U.S. Appl. No. 13/719,417.

* cited by examiner

TOP
REAR
RIGHT
LEFT
FRONT
BOTTOM
13
14
58
81(79)
CPU
82
33R(33)
34
31
35
36
7
48(45)
61
63
50(45)
51
80(79)
42
32
64
62
33L(33)
73
65

58
33R(33)
59
TOP
REAR
RIGHT
LEFT
FRONT
BOTTOM

CARTRIDGE AND IMAGE FORMING APPARATUS PROVIDED THEREWITH

CROSS REFERENCE TO RELATED APPLICATION

This application claims priority from Japanese Patent Application No. 2011-288491 filed Dec. 28, 2011. The entire content of the priority application is incorporated herein by reference.

TECHNICAL FIELD

The present invention relates to a cartridge to be used in an electro-photographic type image forming apparatus, and to an image forming apparatus provided with the cartridge.

BACKGROUND

As an electro-photographic type image forming apparatus, a printer including a photosensitive body and a developing cartridge configured to supply toner to the photosensitive body is known.

A conventional printer is provided with a detection device for detecting information of the developing cartridge assembled therein, for example, for detecting whether or not the assembled developing cartridge is a brand new cartridge.

Japanese Patent Application Publication No. 2006-267994 proposes a laser printer that detects rotation of a detection gear provided in a developing cartridge using an actuator provided in a main casing and that determines information on the developing cartridge based on a detection result.

In the above laser printer, the detection gear has an abutment protrusion corresponding to the information on the developing cartridge. The detection gear is rotated by a predetermined driving amount after assembly of the developing cartridge to the main casing. At this time, the abutment protrusion abuts on the actuator, allowing the rotation of the detection gear to be detected by the actuator.

SUMMARY

However, in the laser printer described above, the developing cartridge only has the detection gear for allowing the main casing to detect the information on the developing cartridge.

Additionally, substantially the entire part of the detection gear is covered by a gear cover, which lowers visibility of the detection gear from outside the apparatus.

Therefore, a user who does not have knowledge of the new cartridge detection device has a difficulty in determining whether the developing cartridge is a new one or a used one.

It is therefore an object of the present invention to provide a cartridge allowing a user to easily determine whether the cartridge is unused or used and an image forming apparatus provided with the cartridge.

In order to attain the above and other objects, the present invention provides a cartridge including: a frame; a rotation body; a driving force transmission unit; a closing member; and a moving member. The frame defines an internal space for accommodating therein developing agent. The frame is formed with a filling port for filling the internal space with the developing agent therethrough. The rotation body has a rotation axis extending in a predetermined direction. The rotation body is provided at the frame and rotatable about the rotation axis relative to the frame. The driving force transmission unit is provided at the frame and configured to transmit an external driving force to the rotation body. The closing member is configured to close the filling port. The moving member is configured to be irreversibly moved to one of a covered position and an exposed position by the external driving force transmitted through the driving force transmission unit. The moving member covers at least a portion of the closing member when the moving member is at the covered position. The moving member exposes the closing member when the moving member is at the exposed position. The exposed position provides an exposing degree greater than that at the covered position.

When the moving member is at the covered position, there may be no exposing degree. In other words, when the moving member is at the covered position, the moving member may cover the closing member in its entirety.

According to another aspect, the present invention provides an image forming apparatus including: a main casing; and a cartridge. The cartridge includes: a frame; a rotation body; a driving force transmission unit; a closing member; and a moving member. The cartridge is detachable from and attachable to the main casing. The frame defines an internal space for accommodating therein developing agent. The frame is formed with a filling port for filling the internal space with the developing agent therethrough. The rotation body has a rotation axis extending in a predetermined direction. The rotation body is provided at the frame and rotatable about the rotation axis relative to the frame. The driving force transmission unit is provided at the frame and configured to transmit a driving force from the main casing to the rotation body. The closing member is configured to close the filling port. The moving member is configured to be irreversibly moved to one of a covered position and an exposed position by the driving force transmitted through the driving force transmission unit. The moving member covers at least a portion of the closing member when the moving member is at the covered position. The moving member exposes the closing member when the moving member is at the exposed position. The exposed position provides an exposing degree greater than that at the covered position. The main casing includes: a detection unit; and a judgment unit. The detection unit is configured to detect a movement of the moving member. The judgment unit is configured to judge a condition of the cartridge based on a detection of the detection unit.

The condition of the cartridge judged by the judgment unit in the present invention implies a usage state of the cartridge whether the cartridge is new or used, types of the cartridge, a remaining amount of toner accommodated in the cartridge, and a position of agitation blades, for example.

Further, when the moving member is at the covered position, there may be no exposing degree. That is, when the moving member is at the covered position, the moving member may cover the closing member in its entirety.

BRIEF DESCRIPTION OF THE DRAWINGS

In the drawings;

FIGS. 9A and 9B are views for description of movement of the shutter; and in which FIG. 9A shows a state where the shutter is at a covered position, and FIG. 9B shows a state where the shutter is at the exposed position;

FIGS. 10A and 10B are views for description of a new cartridge detecting operation; and in which FIG. 10A shows a state where a detection unit is at a new cartridge detection position and the shutter is at the covered position, and FIG. 10B shows a state where the detection unit is at the new cartridge detection position and the shutter is at the exposed position;

FIGS. 12A and 12B illustrate a developing cartridge according to one modification of the present invention; and in which FIG. 12A is a partial perspective view of a cartridge frame of the developing cartridge to which a gear train and a toner cap is assembled as viewed from a lower left side, and FIG. 12B is a view for description of a cartridge type detecting operation showing a state where a detection unit is at a cartridge type detection position and a right end portion of a probe is in confrontation with a fitting portion of the toner cap; and FIGS. 13A and 13B illustrate a cartridge type detecting operation of a developing cartridge according to another modification of the present invention; and in which FIG. 13A shows a cartridge type detection of a developing cartridge corresponding to a first information (predetermined printing times: 6,000 sheets printing), and FIG. 13B shows a cartridge type detection of a developing cartridge corresponding to a second information (predetermined printing times: 3,000 sheets printing).

DETAILED DESCRIPTION

A printer as an image forming apparatus according to one embodiment of the present invention will be described with reference to FIGS. 1 through 11. Throughout the specification, the terms "upward", "downward", "upper", "lower", "above", "below", "beneath", "right", "left", "front", "rear" and the like will be used assuming that the image forming apparatus is disposed in an orientation in which it is intended to be used. More specifically, in FIG. 1 a left side and a right side are a front side and a rear side, respectively.

1. Overall Structure of Color Printer

Figure 1:
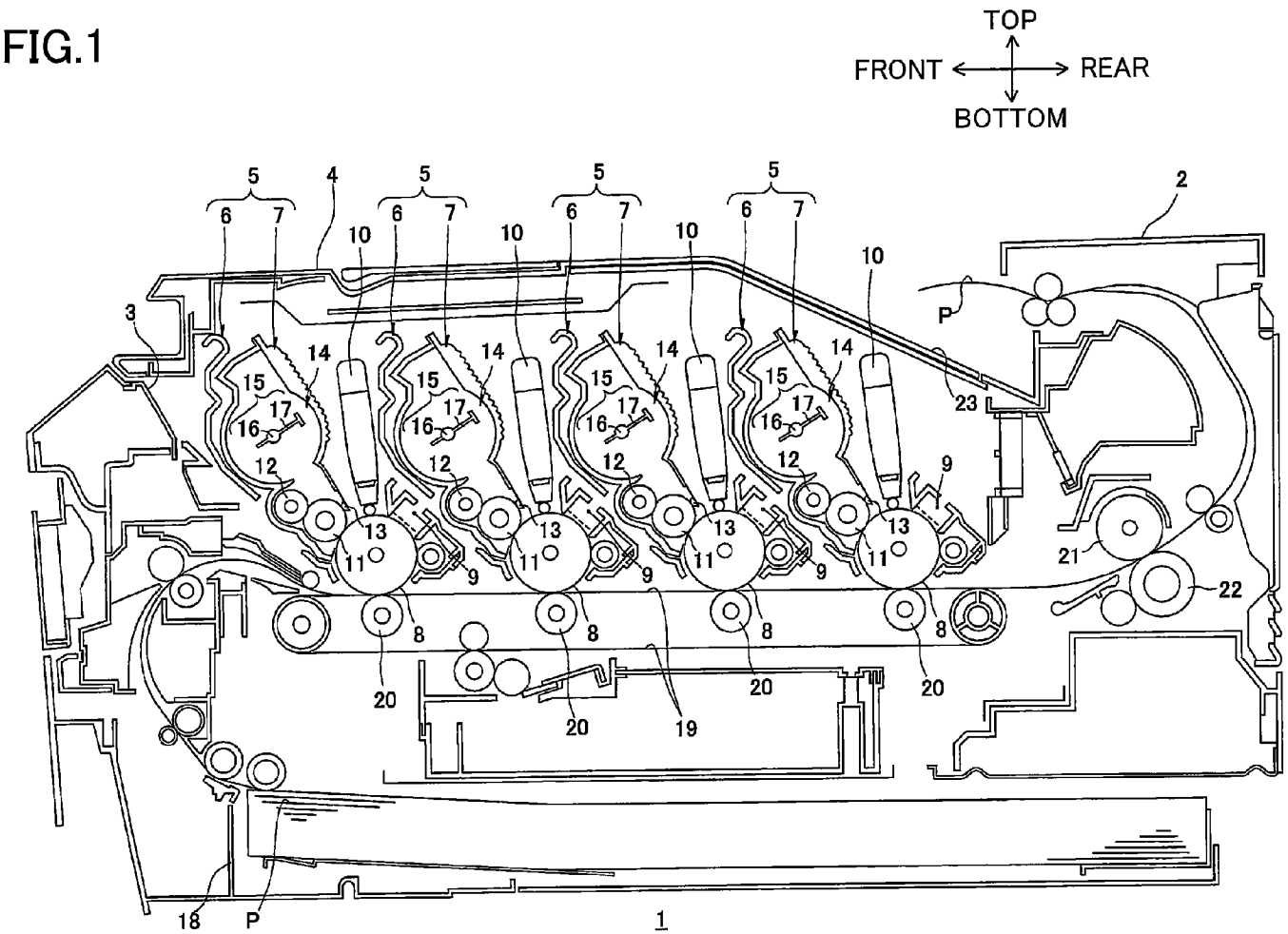
FIG. 1 is a cross-sectional view of a printer according to one embodiment of the present invention.

Referring to FIG. 1, the printer 1 is a horizontal direct tandem type color printer. The printer 1 includes a main casing 2 having a generally box shape. The main casing 2 has an upper portion provided with a top cover 4 which can be opened or closed for opening and closing an opening 3. The top cover 4 has a rear end portion pivotally movably supported to the main casing 2. The printer 1 includes four process cartridges 5.

Each process cartridge 5 is detachable from and attachable to the main casing 2. When mounted, the process cartridges 5 are juxtaposedly arrayed in the frontward/rearward direction at intervals within the main casing 2. The four process cartridges 5 corresponds to four colors different from each other (black, yellow, magenta, and cyan), respectively.

Each process cartridge 5 includes a drum cartridge 6 and a developing cartridge 7 detachable from and attachable to the drum cartridge 6.

Each drum cartridge 6 has a photosensitive drum 8. The photosensitive drum 8 is cylindrical in shape and extends in a lateral direction (rightward/leftward direction), and is rotatably supported to a frame of the drum cartridge 6.

Further, the drum cartridge 6 has a scorotron charger 9 and an LED unit 10. The scorotron charger 9 is positioned diagonally above and rearward of the photosensitive drum 8, and confronts the photosensitive drum 8. The LED unit 10 is positioned above the photosensitive drum 8, and confronts the photosensitive drum 8.

The developing cartridge 7 has a developing roller 11 and a supply roller 12 adapted to supply toner to the developing roller 11.

The developing roller 11 has a rotation shaft extending in the lateral direction. The developing roller 11 is rotatably supported in a rear end portion of the developing cartridge 7 such that each lateral end portion of the rotation shaft is rotatably supported to each side wall 33 of a cartridge frame 31 (FIG. 2, described later) of the developing cartridge 7. A rear edge of the developing roller 11 is exposed to an outside through a rear edge of the developing cartridge 7 and contacts the corresponding photosensitive drum 8 from an upper front side thereof.

The supply roller 12 has a rotation shaft extending in the lateral direction. The supply roller 12 is rotatably supported in the developing cartridge 7 such that each lateral end portion of the rotation shaft is rotatably supported to each side wall 33 of the cartridge frame 31 (described later). The supply roller 12 is disposed diagonally above and frontward of the developing roller 11 and in contact therewith.

The developing cartridge 7 is provided with a layer thickness regulation blade 13, a toner chamber 14 and an agitator 15. The layer thickness regulation blade 13 is adapted to regulate a thickness of a toner layer supplied to the developing roller 11. The toner chamber 14 is positioned above the developing roller 11 and the supply roller 12. The toner chamber 14 accommodates toner therein.

The agitator 15 is provided in the toner chamber 14 for agitating the toner. The agitator 15 includes an agitator shaft 16 extending in the lateral direction and agitation blades 17 extending radially toward an inner circumferential surface of the toner chamber 14 from the agitator shaft 16. The agitator 15 is adapted to rotate about an axis A (FIG. 3) of the agitator shaft 16.

Toner accommodated in the toner chamber 14 is subjected to tribo-electric charging to have a positive polarity between the supply roller 12 and the developing roller 11. The toner is carried on an outer peripheral surface of the developing roller 11 in a form of a thin toner layer having a uniform thickness by the layer thickness regulation blade 13.

After an outer peripheral surface of the photosensitive drum 8 is uniformly charged by the scorotron charger 9, the surface is exposed to light by the LED unit 10 based on a predetermined image data to form an electrostatic latent image on the surface. Then, a visible toner image (developing agent image) corresponding to the electrostatic latent image is formed on the outer peripheral surface of the photosensitive drum 8 by supplying toner carried on the developing roller 11 to the corresponding photosensitive drum 8.

A sheet cassette 18 is provided at a bottom portion of the main casing 2 for accommodating sheets P therein in a stacked state. Each sheet P accommodated in the sheet cassette 18 is passed through a U-shaped passage and is conveyed diagonally upward and rearward to a position between the photosensitive drum 8 and a conveyor belt 19 at a prescribed timing by various rollers. Then, each sheet P is conveyed rearward by the conveyer belt 19 at a position between each photosensitive drum 8 and each transfer roller 20. At this time, the toner image is transferred onto the sheet P.

The sheet P onto which the toner image has been transferred is then conveyed to a fixing unit provided downstream of the conveyer belt 19. The fixing unit includes a heat roller 21 and a pressure roller 22. The toner image is thermally fixed to the sheet P when the sheet P passes through the heat roller 21 and the pressure roller 22. The sheet P carrying the toner image is then conveyed through an U-shaped passage frontward and upward, and is discharged onto a discharge tray 23 provided at the top cover 4.

2. Details of Developing Cartridge

Figures 2A, 2B:
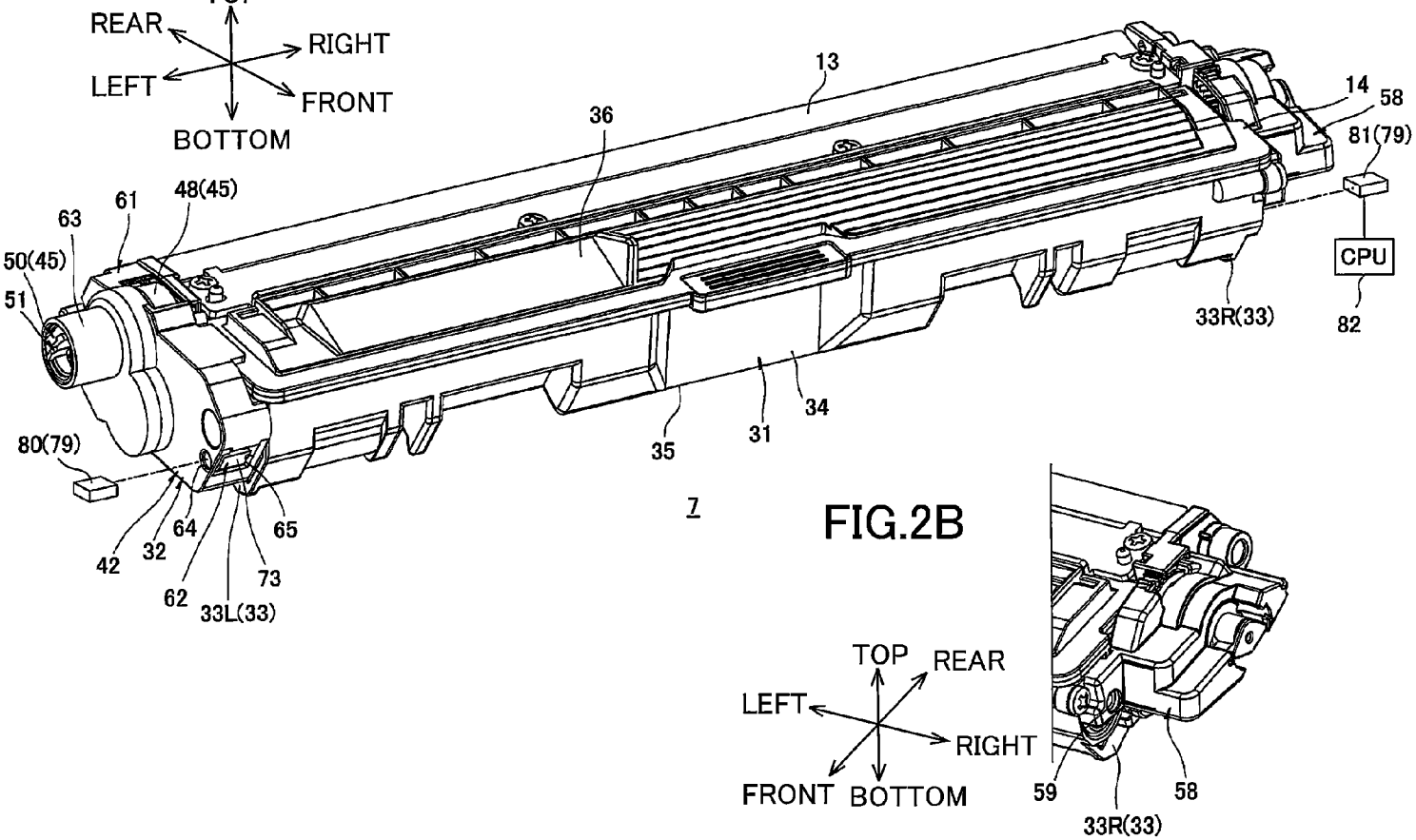
FIG. 2A is a perspective view of a developing cartridge accommodated in the printer shown in FIG. 1 as viewed from a diagonally front left side.
FIG. 2B is a perspective view of a right end portion of the developing cartridge of FIG. 2A as viewed from a diagonally front right side.
Figure 3:
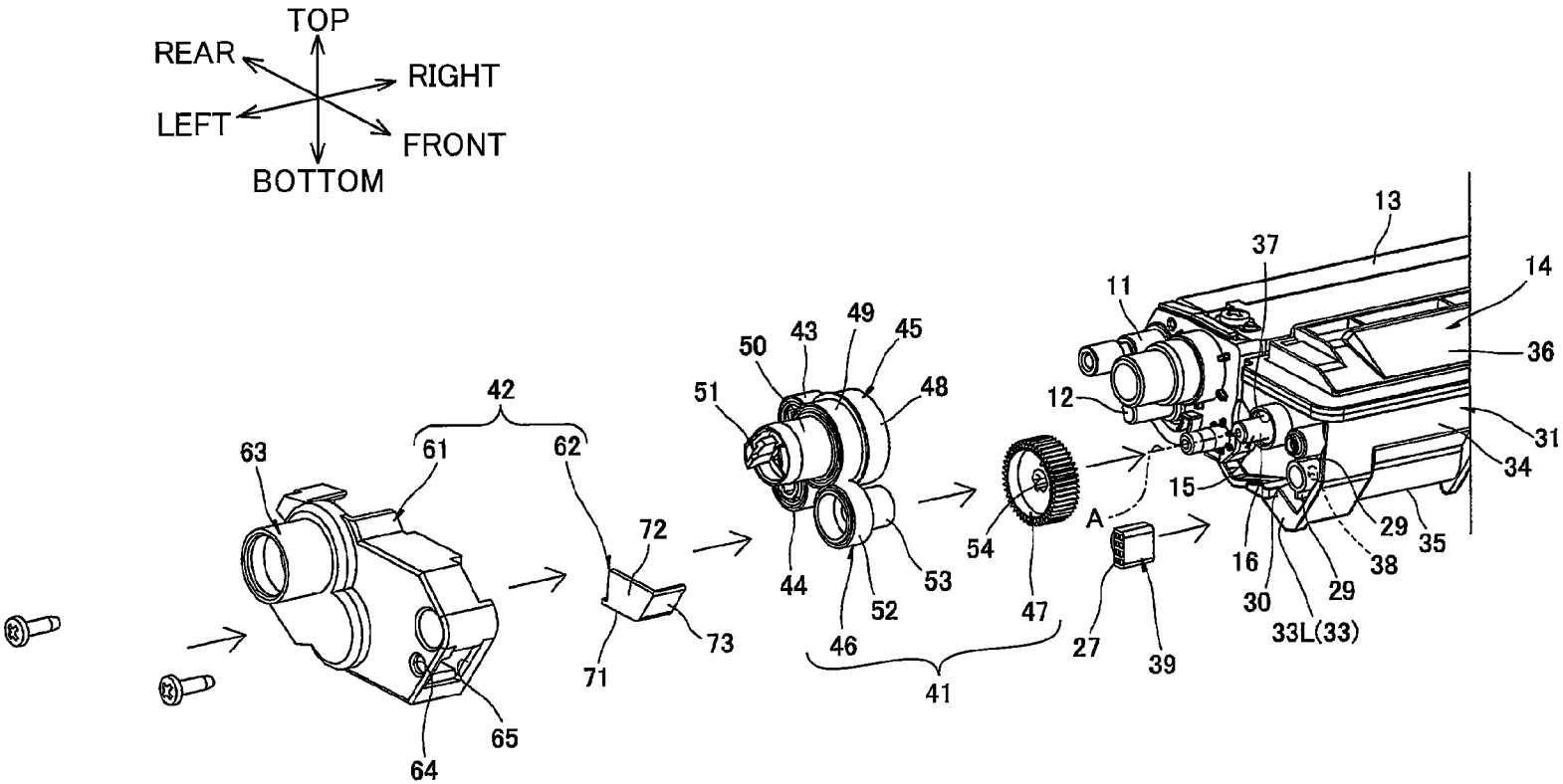
FIG. 3 is an exploded perspective view of the developing cartridge of FIG. 2A.

As shown in FIGS. 2 and 3, the developing cartridge 7 includes a cartridge frame 31 and a drive unit 32 positioned at a left side of the cartridge frame 31.

When referring to the directions in the description of the developing cartridge 7, the terms "upward", "downward", "upper", "lower", "above", "below", "beneath", "right", "left", "front", "rear" and the like will be used assuming that the developing cartridge 7 is detached from the main casing 2 and placed on a horizontal plane. Specifically, a side on which the developing roller 11 is disposed is defined as the rear side, and a side on which the layer thickness regulation blade 13 is disposed is defined as the upper side.

(1) Cartridge Frame

The cartridge frame 31 extends in the lateral direction and is generally box shaped, as shown in FIGS. 2A and 3. The cartridge frame 31 includes the pair of side walls 33, a front wall 34, a lower wall 35 and an upper wall 36. The pair of side walls 33 includes a left side wall 33L and a right side wall 33R.

Each side wall 33 extends in the frontward/rearward direction and in the vertical direction, and is generally rectangular shaped in a side view. The pair of side walls 33 is spaced away from each other in the lateral direction.

The left side wall 33L is formed with an agitator shaft exposure hole 37, and a toner filling port 38. Further, the left side wall 33L is provided with a toner cap fitting portion 30, and a toner cap 39.

The agitator shaft exposure hole 37 is formed for exposing the agitator shaft 16 to the outside therethrough. The agitator shaft exposure hole 37 is positioned at a generally center portion of the left side wall 33L in the frontward/rearward direction and is generally circular shaped in a side view. The agitator shaft exposure hole 37 is penetrated through a thickness of the left side wall 33L and has a diameter greater than an outer diameter of a left end portion of the agitator shaft 16. The left end portion of the agitator shaft 16 extends through the agitator shaft exposure hole 37 and protrudes laterally outward from the left side wall 33L.

The toner filling port 38 is formed in a front end portion of the left side wall 33L and penetrated through a thickness of the left side wall 33L. The toner filling port 38 is generally circular shaped in a side view. The toner filling port 38 is formed for filling the toner chamber 14 with the toner therethrough.

The toner cap fitting portion 30 is generally hollow cylindrical shaped extending leftward from a peripheral portion of the toner filling port 38. The toner cap fitting portion 30 has an engaged portion 29 with which an engagement portion 28 (described later, FIG. 4) of a toner cap 39 (described later, FIG. 4) is engaged.

The engaged portion 29 is a pair of protrusions, one protruding radially outwardly upward from an upper end portion of an outer peripheral surface of the toner cap fitting portion 30 and extending in the lateral direction, and another protruding radially outwardly downward from a lower end portion of the outer peripheral surface of the toner cap fitting portion 30 and extending in the lateral direction.

Figure 4:
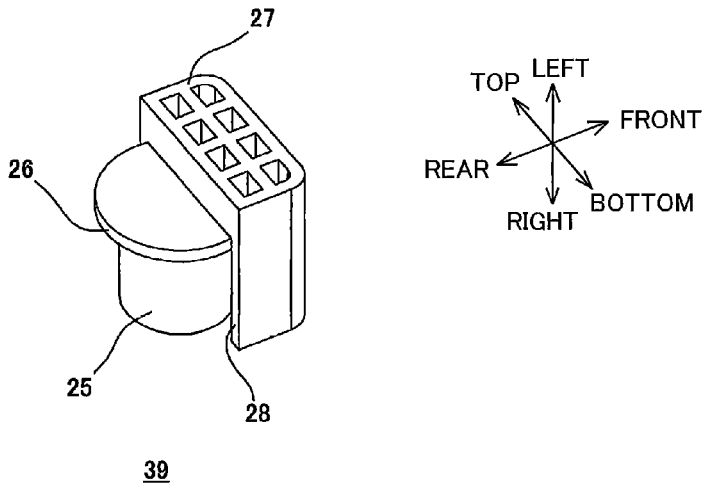
FIG. 4 is a perspective view of a toner cap of FIG. 3 as viewed from a left side.

As shown in FIG. 4, the toner cap 39 is made of a transparent resin.

The toner cap 39 integrally includes a fitting portion 25, a flange portion 26, a projecting portion 27, and an engagement portion 28.

The fitting portion 25 is a generally columnar shaped extending in the lateral direction. The fitting portion 25 has an outer diameter equal to an inner diameter of the toner cap fitting portion 30.

The flange portion 26 is provided entirely along a peripheral direction of the fitting portion 25 so as to protrude radially outward from a left end portion of an outer peripheral surface of the fitting portion 25. The flange portion 26 has an outer diameter equal to an outer diameter of the toner cap fitting portion 30.

The projecting portion 27 is generally rectangular shaped in a side view, elongated in the vertical direction. The projecting portion 27 projects leftward from a half portion of the fitting portion 25 in a radial direction thereof. The projecting portion 27 has a vertical length greater than a diameter of the flange portion 26 of the fitting portion 25.

The engagement portion 28 is generally rectangular flat-plate shaped in a plan view, extending rightward from both upper and lower end portions (i.e. portions projecting vertically outward from the flange portion 26) of the projecting portion 27.

Figure 5:
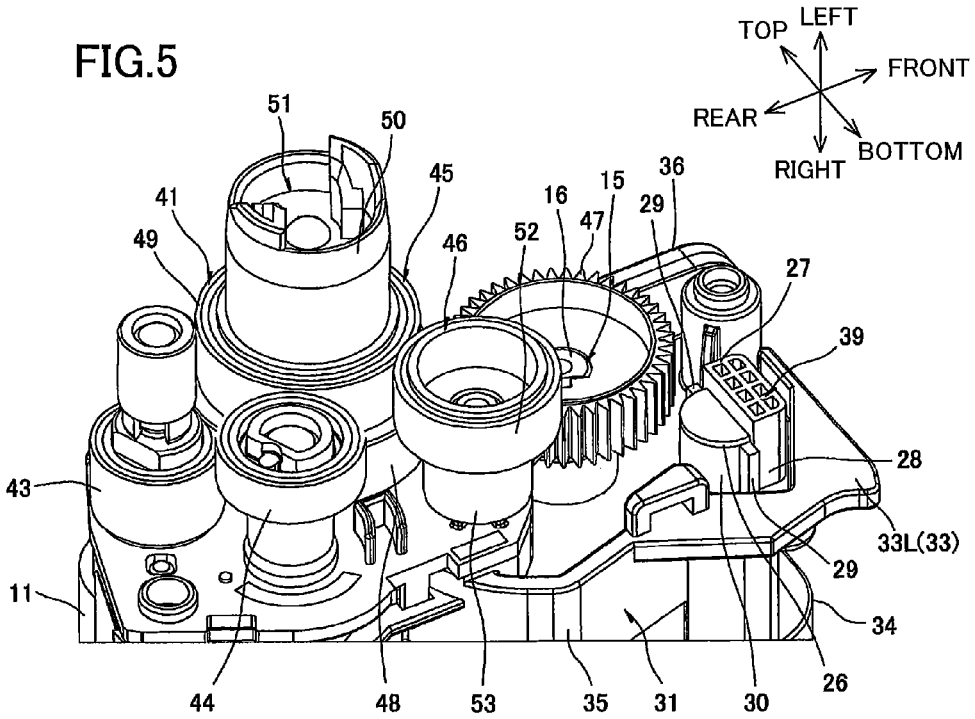
FIG. 5 is a partial perspective view of a cartridge frame of FIG. 3 to which a gear train and the toner cap is assembled as viewed from a lower left side.

As shown in FIG. 5, the toner cap 39 is fitted into the toner cap fitting portion 30 at the fitting portion 25 of the toner cap 39 such that the engagement portion 28 of the toner cap 39 confronts the engaged portion 29 of the toner cap fitting portion 30 and is positioned frontward of the engaged portion 29 of the toner cap fitting portion 30. That is, the toner cap 39 is fitted into the toner cap fitting portion 30 such that the projecting portion 27 is disposed frontward of the fitting portion 25. As a result, the toner cap 39 closes the toner filling port 38.

The agitator shaft 16 has a right end portion which is rotatably supported to the right side wall 33R. Further, the right side wall 33R is formed with a detection window (not shown). The detection window of the right side wall 33R is superposed with the toner filling port 38 when projected in the lateral direction.

Further, as shown in FIGS. 2A and 2B, the right side wall 33R is provided with a power supply unit 58. The power supply unit 58 is adapted to supply electric power from the main casing 2 to the developing cartridge 7. The power supply unit 58 is formed with a detection window 59. The detection window 59 of the power supply unit 58 is superposed with the toner filling port 38 when projected in the lateral direction.

The detection window (not shown) of the right side wall 33R is closed by a transparent resin plate. The detection window 59 of the power supply unit 58 remains open.

The front wall 34 extends in the lateral direction and is spanned between front end portions of the side walls 33. The lower wall 35 extends in the lateral direction and is spanned between lower end portions of the side walls 33 such that the lower wall 35 is connected to a lower end portion of the front wall 34. The upper wall 36 extends in the lateral direction and is spanned between upper end portions of the side walls 33 such that the upper wall 36 is connected to an upper end portion of the front wall 34.

(2) Drive Unit

As shown in FIGS. 3 and 5, the drive unit 32 includes a gear train 41 and a gear cover 42 for covering the gear train 41.

(2-1) Gear Train

The gear train 41 includes a developing gear 43, a supply gear 44, a developing coupling 45, an idle gear 46, and an agitator gear 47. The gear train 41 is adapted to transmit a driving force from the main casing 2 to the agitator 15.

The developing gear 43 is assembled to a left side of the left side wall 33L of the cartridge frame 31. The developing gear 43 is fixedly coupled to a left end portion of the rotation shaft of the developing roller 11 protruding leftward from the left side wall 33L such that relative rotation therebetween is prevented.

The supply gear 44 is assembled to the left side of the left side wall 33L of the cartridge frame 31. The supply gear 44 is fixedly coupled to a left end portion of the rotation shaft of the supply roller 12 protruding leftward from the left side wall 33L such that relative rotation therebetween is prevented. The supply gear 44 is positioned below and spaced apart from the developing gear 43.

The developing coupling 45 is rotatably supported to the left side wall 33L of the cartridge frame 31 and positioned frontward of the developing gear 43. The developing coupling 45 is generally cylindrical shaped extending in the lateral direction. The developing coupling 45 integrally includes a large-diameter gear portion 48, a small-diameter gear portion 49, and a coupling portion 50.

The large-diameter gear portion 48 is provided at a right end portion of the developing coupling 45. Gear teeth are provided along the entire circumferential surface of the large-diameter gear portion 48. The large-diameter gear portion 48 is meshingly engaged with the developing gear 43 from a front side thereof.

The small-diameter gear portion 49 is generally cylindrical shaped extending leftward continuously from a left end portion of the large-diameter gear portion 48 and coaxial with the large-diameter gear portion 48. The small-diameter gear portion 49 has an outer diameter smaller than that of the large-diameter gear portion 48. Gear teeth are provided along the entire circumferential surface of the small-diameter gear portion 49. The small-diameter gear portion 49 is meshingly engaged with the supply gear 44 from an upper-front side thereof.

The coupling portion 50 is generally cylindrical shaped extending leftward continuously from a left end portion of the small-diameter gear portion 49 and coaxial with the large-diameter gear portion 48. The coupling portion 50 has an outer diameter smaller than that of the small-diameter gear portion 49. The coupling portion 50 has a left side surface provided with a fitting portion 51. In a state where the developing cartridge 7 is assembled to the main casing 2, a leading end portion of a main coupling (not shown) provided to the main casing 2 is fixedly coupled to the fitting portion 51 such that relative rotation therebetween is prevented. A driving force from the main casing 2 is transmitted to the fitting portion 51 through the main coupling (not shown).

The idle gear 46 is rotatably supported to the left side wall 33L of the cartridge frame 31 at a front side of the developing coupling 45. The idle gear 46 is generally disk shaped having a thickness in the lateral direction. The idle gear 46 integrally includes a large-diameter portion 52 and a small-diameter portion 53.

The large-diameter portion 52 constitutes a left half portion of the idle gear 46. The large-diameter portion 52 is generally disk shaped having gear teeth formed along the entire circumference thereof. The large-diameter portion 52 is meshingly engaged with the small-diameter gear portion 49 of the developing coupling 45 from a lower-front side thereof.

The small-diameter portion 53 constitutes a right half portion of the idle gear 46 and is coaxial with the large-diameter portion 52. The small-diameter portion 53 is generally disk shaped having gear teeth formed along the entire circumference thereof. The small-diameter portion 53 is disposed diagonally below and frontward of the large-diameter gear portion 48 of the developing coupling 45 and spaced apart therefrom.

The agitator gear 47 is fixedly coupled to a left end portion of the agitator shaft 16 protruding leftward from the left side wall 33L such that relative rotation therebetween is prevented. The agitator gear 47 is rotatably supported to the left side wall 33L of the cartridge frame 31 through the agitator shaft 16. The agitator gear 47 is meshingly engaged with the small-diameter portion 53 of the idle gear 46 from an upper front side thereof.

(2-2) Gear Cover

As shown in FIG. 3, the gear cover 42 includes a main portion 61 and a shutter 62.

Figure 6:
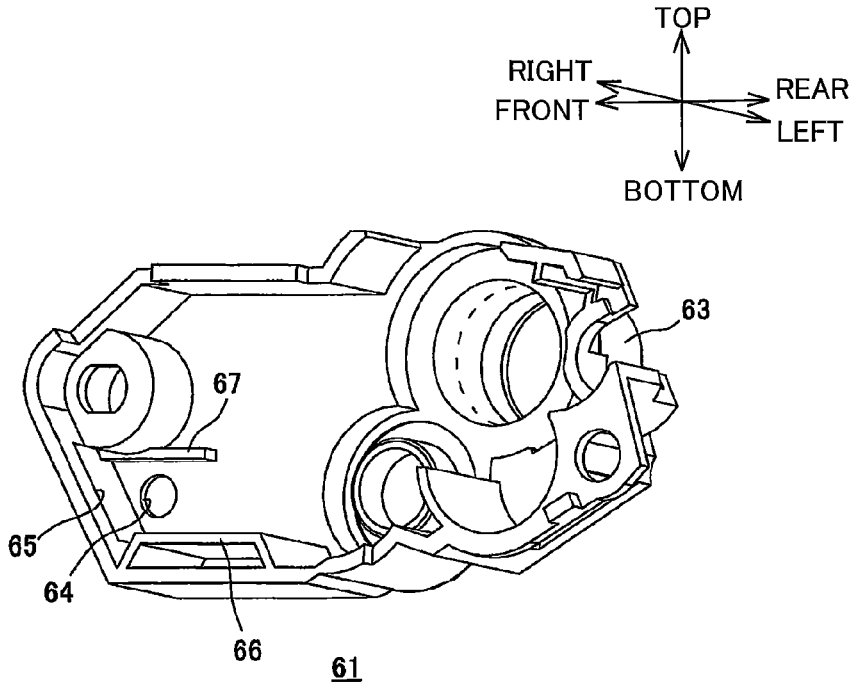
FIG. 6 is a perspective view of a gear cover of FIG. 3 as viewed from a diagonally rear right side.

As shown in FIGS. 3 and 6, the main portion 61 is generally hollow prismatic body shaped and extends in the lateral direction with its leftmost end being closed. The main portion 61 includes a collar portion 63, a support portion 66, and a regulation portion 67. Further, the main portion 61 is formed with a detection opening 64 and an exposure opening 65.

The collar portion 63 is positioned at a rear end portion of a left wall of the main portion 61 and protrudes leftward from the left wall of the main portion 61.

The collar portion 63 is generally hollow cylindrical shaped with its right end portion being in communication with an internal space of the main portion 61.

The coupling portion 50 of the developing coupling 45 extends through the collar portion 63 and is rotatable relative to the collar portion 63. The fitting portion 51 of the coupling portion 50 is exposed to the outside through a left end portion of the collar portion 63.

The detection opening 64 is generally circular shaped in a side view. The detection opening 64 is positioned at a front end portion of the left wall of the main portion 61 such that the detection opening 64 confronts the toner cap 39 from a left side thereof. The detection opening 64 is penetrated through a thickness of the left wall of the main portion 61.

The exposure opening 65 is generally square shaped in a front view. The exposure opening 65 is positioned at a lower end portion of a front wall of the main portion 61. The exposure opening 65 is penetrated through a thickness of the front wall of the main portion 61.

The support portion 66 is generally rectangular shaped in a side view and elongated in the frontward/rearward direction. The support portion 66 is disposed at a right surface side of the left wall of the main portion 61 and at a rear side of a lower end portion of the exposure opening 65. The support portion 66 protrudes upward from a lower wall of the main portion 61.

The regulation portion 67 is a protrusion protruding rightward from the left wall of the main portion 61 and extending in the frontward/rearward direction. The regulation portion 67 is disposed at the right surface side of the left wall of the main portion 61 and at a rear side of an upper end portion of the exposure opening 65.

Figure 7:
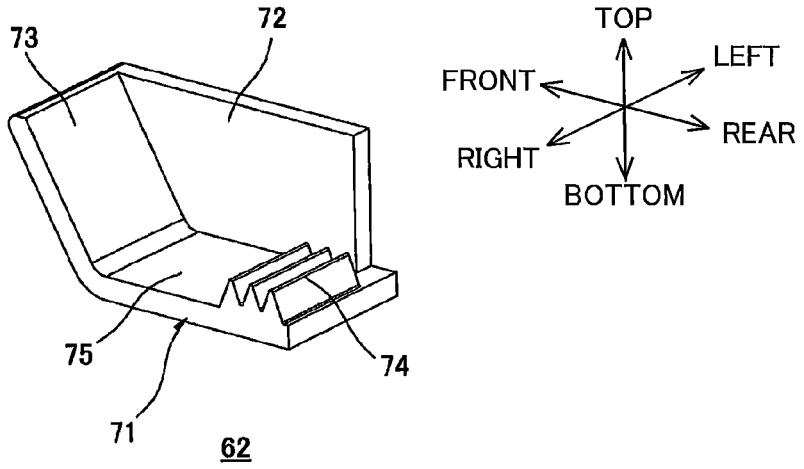
FIG. 7 is a perspective view of a shutter of FIG. 3 as viewed from a diagonally rear right side.

As shown in FIGS. 3 and 7, the shutter 62 integrally includes a slider 71, a display portion 73, and a cover portion 72.

The slider 71 is generally flat plate shaped extending in the frontward/rearward direction. Gear teeth are provided at an upper surface of a rear end portion of the slider 71. In the slider 71, a portion where gear teeth are provided will be referred to as a toothed portion 74, and a portion where gear teeth are not provided will be referred to as an untoothed portion 75.

The display portion 73 is generally rectangular flat-plate shaped in a front view extending continuously from a front end portion of the slider 71 and inclined diagonally upward toward a front side of the display portion 73.

The cover portion 72 is generally rectangular flat-plate shaped in a side view extending upward continuously from left end portions of the slider 71 and the display portion 73.

Figure 8:
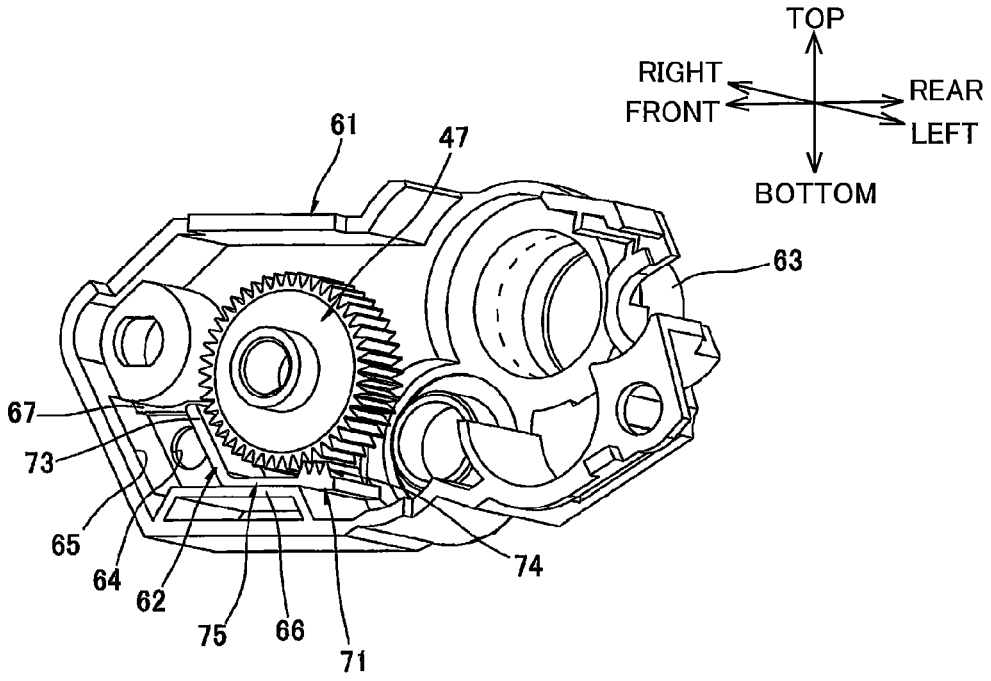
FIG. 8 is a view for description of relative positional relationship among the gear cover, the shutter, and an agitator gear.

As shown in FIG. 8, within the main portion 61, the shutter 62 is slidably mounted on the support portion 66 of the main portion 61 such that the cover portion 72 is positioned between the support portion 66 and regulation portion 67.

Figure 9A:
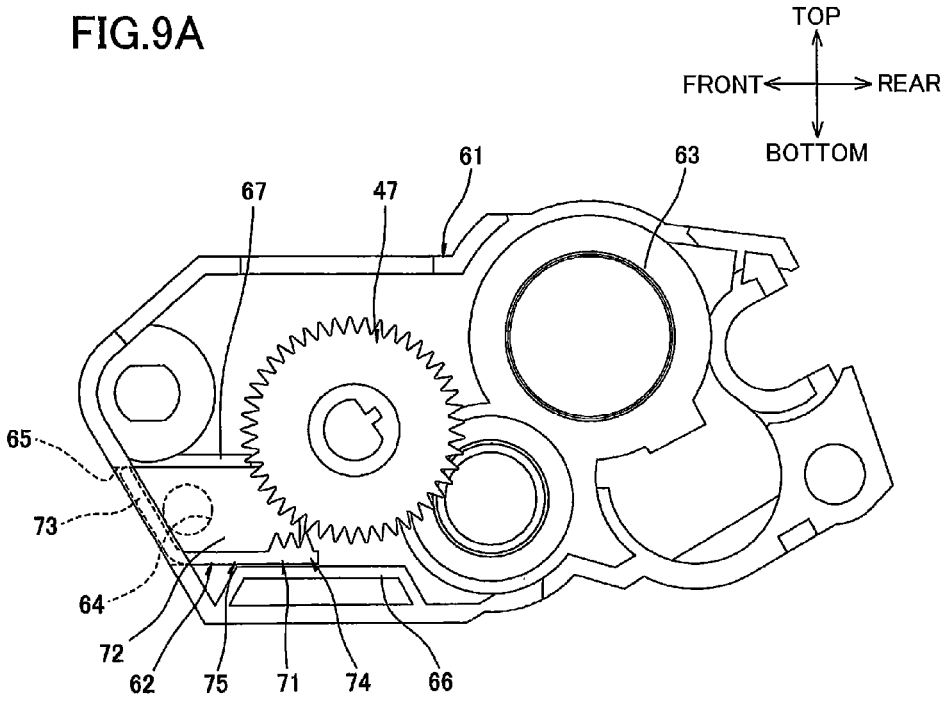
Figure 9B:
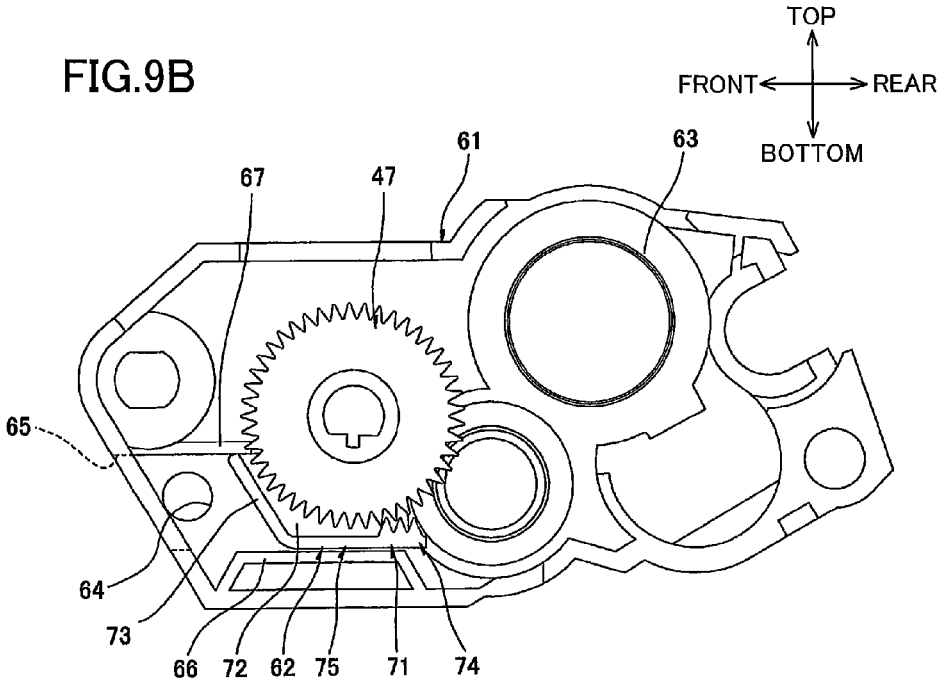

This configuration allows the shutter 62 to move to a covered position (FIG. 9A) and to an exposed position (FIG. 9B). At the covered position, the shutter 62 covers the toner cap 39. At the exposed position, the shutter 62 allows the toner cap 39 to be exposed to the outside.

When the shutter 62 is at the covered position (FIG. 9A), the cover portion 72 of the shutter 62 is interposed between the detection opening 64 and the toner cap 39. Further, the display portion 73 of the shutter 62 is exposed to the outside (a front side of the exposure opening 65) through the exposure opening 65 of the main portion 61. Further, the toothed portion 74 of the shutter 62 is meshingly engaged with a lower end portion of the agitator gear 47.

When the shutter 62 is at the exposed position (FIG. 9B), the cover portion 72 of the shutter 62 is retracted rearward from a position between the detection window 64 and the toner cap 39. At this time, the display portion 73 of the shutter 62 is retracted rearward from the exposure opening 65 of the main portion 61. Further, the toothed portion 74 of the shutter 62 is positioned rearward of the agitator gear 47 and spaced apart therefrom. The untoothed portion 75 of the shutter 62 confronts the agitator gear 47 from a lower side thereof. As a result, meshing engagement between the toothed portion 74 of the shutter 62 and the agitator gear 47 is released.

3. Main Casing

As shown in FIGS. 2, 10A, 10B, and 11, a detection unit 78, an empty sensor unit 79, and a CPU 82 are provided within the main casing 2.

Figure 10A:
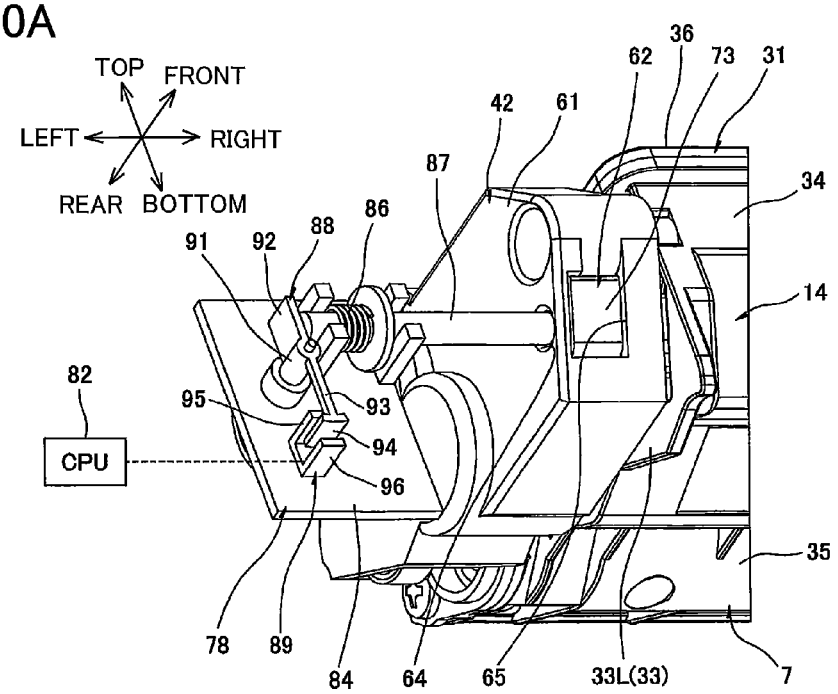

The detection unit 78 is positioned at a left side of the developing cartridge 7 within the main casing 2. As shown in FIGS. 10A through 11, the detection unit 78 includes a slide member 84, a probe 87, an actuator 88, and a photo-sensor 89.

The slide member 84 is a generally rectangular flat plate shaped extending in the vertical direction. The slide member 84 is slidably movable in the lateral direction by a moving mechanism (not shown).

The probe 87 is generally cylindrical shaped extending in the lateral direction. The probe 87 is movably supported in the slide member 84. The probe 87 is slidably movable in the lateral direction to an advanced position (FIG. 10B) and to a retracted position (FIGS. 10A and 11). At the advanced position, the probe 87 is advanced rightward, and at the retracted position, the probe 87 is retracted leftward from the advanced position. The probe 87 is connected to a compression coil spring 86, so that the probe 87 is normally urged rightward by the compression coil spring 86 so as to be positioned at the advanced position.

The actuator 88 integrally includes a pivot shaft 91, an abutment lever 92, and a light shielding lever 93. The pivot shaft 91 extends in the frontward/rearward direction and is generally hollow cylindrical shaped. The abutment lever 92 extends upward from the pivot shaft 91. The light shielding lever 93 extends downward from the pivot shaft 91. The light shielding lever 93 has a lower end portion provided with a light shielding plate 94 extending in the lateral direction.

The actuator 88 is supported to the slide member 84 and pivotally movable relative to the slide member 84 about the pivot shaft 91.

The actuator 88 is pivotally movable to a light transmitting position (FIG. 10B) and to a light shielding position (FIGS. 10A and 11). At the light transmitting position, the abutment lever 92 is directed diagonally upward and rightward and the light shielding lever 93 is directed diagonally downward and leftward. At the light shielding position, the abutment lever 92 and the light shielding lever 93 are directed in the vertical direction.

The photo-sensor 89 includes a light emitting portion 95 and a light receiving portion 96. The light emitting portion 95 is adapted to emit a light. The light receiving portion 96 is adapted to receive the light from the light emitting portion 95 and positioned in confrontation with and downward of the light emitting portion 95 with a gap therebetween. The photo-sensor 89 is positioned below the actuator 88 such that the light shielding plate 94 of the actuator 88 at the light shielding position is positioned between the light emitting portion 95 and the light receiving portion 96 in the vertical direction.

At the light shielding position of the actuator 88, the light shielding plate 94 of the actuator 88 is positioned between the light emitting portion 95 and the light receiving portion 96, so that the light emitted from the light emitting portion 95 of the photo-sensor 89 is blocked by the light shielding plate 94 of the light shielding lever 93, whereupon an ON signal is outputted from the photo-sensor 89.

On the other hand, at the light transmitting position of the actuator 88, the light shielding plate 94 of the actuator 88 is retracted leftward from the gap between the light emitting portion 95 and the light receiving portion 96. Thus, the light emitted from the light emitting portion 95 of the photo-sensor 89 is received by the light receiving portion 96. At this time, an ON signal is not outputted from the photo-sensor 89.

Further, the detection unit 78 is movable within the main casing 2 to a new cartridge detection position (FIGS. 10A and 10B) and to a cartridge type detection position (FIG. 11). At the new cartridge detection position, the detection unit 78 detects whether the developing cartridge 7 is new or used. At the cartridge type detection position, the detection unit 78 detects types of the developing cartridge 7.

As shown in FIG. 2, the empty sensor unit 79 includes a light emitting element 80 and a light receiving element 81.

The light emitting element 80 is positioned within the main casing 2 and in confrontation with the detection opening 64 of the gear cover 42 from a left side thereof. The light emitting element 80 is adapted to emit a detection light to the detection opening 64.

The light receiving element 81 is positioned within the main casing 2 and in confrontation with the detection window (not shown) of the right side wall 33R of the cartridge frame 31 from a right side thereof. The light receiving element 81 outputs an ON signal upon receipt of the detection light emitted from the light emitting element 80.

A combination of the detection unit 78 and the empty sensor unit 79 constitutes a detection unit.

The CPU 82 is electrically connected to the photo-sensor 89 and the light receiving element 81 so as to receive the ON signal from the photo-sensor 89 and the ON signal from the light receiving element 81.

4. Operation for Detecting New Developing Cartridge

An operation for detecting a new developing cartridge 7 will be described. Note that, in the present embodiment, when the developing cartridge 7 is an unused (new) cartridge, the shutter 62 is at the covered position. That is, the covered position of the shutter 62 indicates that the developing cartridge 7 is unused (new).

In order to assemble the unused developing cartridge 7 into the main casing 2, the unused developing cartridge 7 is first attached to the drum cartridge 6.

At this time, a user looks at the gear cover 42 of the developing cartridge 7 to confirm that the display portion 73 of the shutter 62 is exposed to the outside through the exposure opening 65. Thus, the user can determine that the developing cartridge 7 is unused. In order to let the user know how to determine whether the developing cartridge 7 is new or used, for example, the following description is given in an instruction manual of the printer 1: the developing cartridge 7 is unused in a case where the display portion 73 of the shutter 62 is exposed to the outside through the exposure opening 65, while the developing cartridge 7 is in a used state in a case where the display portion 73 of the shutter 62 is not exposed to the outside through the exposure opening 65. The user may determine a used or unused state of the developing cartridge 7 by looking at the shutter 62 as to whether the shutter 62 is visible or invisible through the detection opening 64.

Then, in order to assemble the unused developing cartridge 7 into the main casing 2, the top cover 4 of the main casing 2 is opened to insert, from diagonally above and frontward thereof, into the main casing 2 the process cartridge 5 to which the unused developing cartridge 7 is assembled. After the process cartridge 5 is inserted into the main casing 2, the top cover 4 is closed. In association with closing movement of the top cover 4, the main coupling (not shown) provided in the main casing 2 is coupled to the developing coupling 45, preventing relative rotation therebetween.

As shown in FIG. 10A, the detection unit 78 is positioned at the new cartridge detection position before the main coupling (not shown) is driven.

Then, a right end portion of the probe 87 is brought into contact with the cover portion 72 of the shutter 62 from a left side thereof through the detection opening 64 of the main portion 61.

Then, the probe 87 is pressed leftward against the urging force of the compression coil spring 86 to be positioned at the retracted position. At the same time, the actuator 88 is pivotally moved in the counterclockwise direction in a front view to be positioned at the light shielding position As a result, the photo-sensor 89 outputs the ON signal to the CPU 82. That is, the detection unit 78 detects the covered position of the shutter 62.

Then, the CPU 82 determines that the shutter 62 has been positioned at the covered position upon receipt of the ON signal from the photo-sensor 89 in a state where the detection unit 78 is at the new cartridge detection position.

Then, a driving force from the main casing 2 is transmitted to the developing coupling 45 through the main coupling (not shown) for starting a warm-up operation. Then, a driving force from the developing coupling 45 is transmitted to the agitator gear 47 through the gear train 41. As a result of rotation of the agitator gear 47 in the clockwise direction in a left side view, the agitator 15 is rotated in the clockwise direction in a left side view.

At the same time, the clockwise rotation of the agitator gear 47 in a left side view causes the shutter 62 to move from the covered position to the exposed position.

Figure 10B:
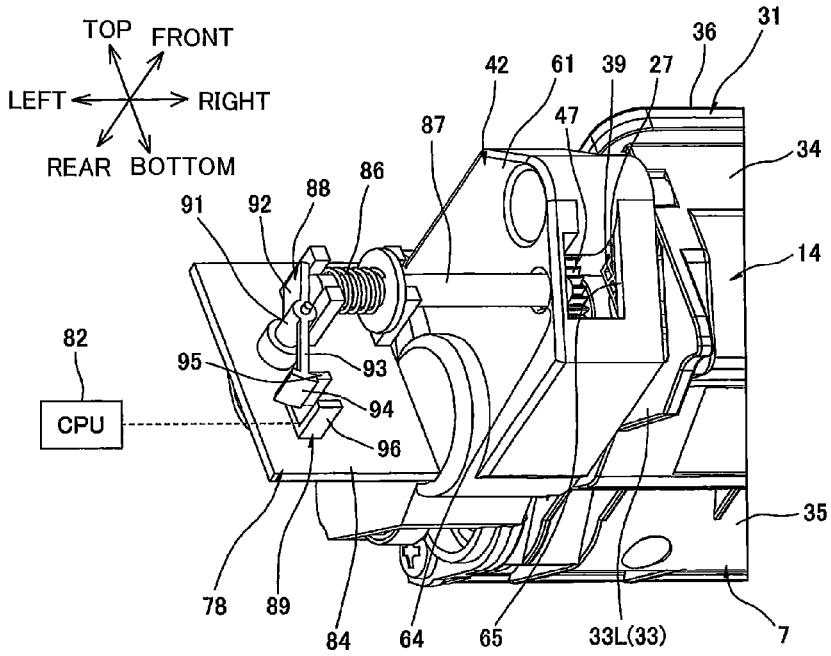
Figure 11:
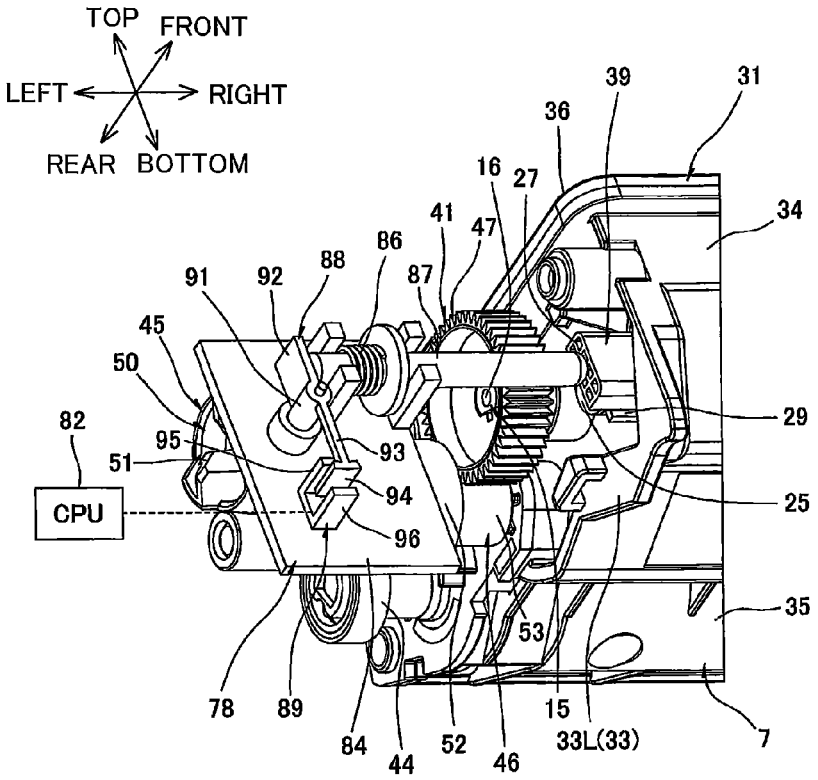
FIG. 11 is a view for description of a cartridge type detecting operation, and shows a state where the detection unit is at a cartridge type detection position and a right end portion of a probe is in abutment with a projecting portion of the toner cap.

Then, as shown in FIG. 10B, the cover portion 72 of the shutter 62 is retracted rearward from a position between the detection opening 64 and the toner cap 39, and the probe 87 is pressed rightward by the urging force of the compression coil spring 86 to be positioned at the advanced position. At the same time, the actuator 88 is pivotally moved in the clockwise direction in a front view from the light shielding position to the light transmitting position.

As a result, output of the ON signal from the photo-sensor 89 to the CPU 82 is interrupted. That is, the detection unit 78 detects the exposed position of the shutter 62.

Then, the CPU 82 determines that the shutter 62 has been moved from the covered position to the exposed position due to interruption of the ON signal from the photo-sensor 89.

When having sequentially determined, within a predetermined period of time, that the shutter 62 is positioned at the covered position and the shutter 62 is positioned at the exposed position, the CPU 82 determines that the developing cartridge 7 is unused.

That is, the CPU 82 determines that the developing cartridge 7 is an unused cartridge when the detection unit 78 detects a movement of the shutter 62 from the covered position to the exposed position within a predetermined time period.

Subsequently, as shown in FIG. 11, the detection unit 78 is moved rightward to be positioned at the cartridge type detection position while the agitator gear 47 is rotated continuously.

Then, the right end portion of the probe 87 is brought into contact with the projecting portion 27 of the toner cap 39 from a left side thereof.

Then, the probe 87 is pressed leftward against the urging force of the compression coil spring 86 to be positioned at the retracted position. At the same time, the actuator 88 is pivotally moved in the counterclockwise direction in a front view to be positioned at the light shielding position.

As a result, the photo-sensor 89 outputs the ON signal to the CPU 82.

Then, the CPU 82 determines that the projecting portion 27 of the toner cap 39 has been detected upon receipt of the ON signal from the photo-sensor 89 in a state where the detection unit 78 is at the cartridge type detection position.

In this case, based on the detection of the projecting portion 27 of the toner cap 39, the CPU 82 determines that a predetermined printing times of the developing cartridge 7 is 6,000 sheets printing.

Figure 12A:
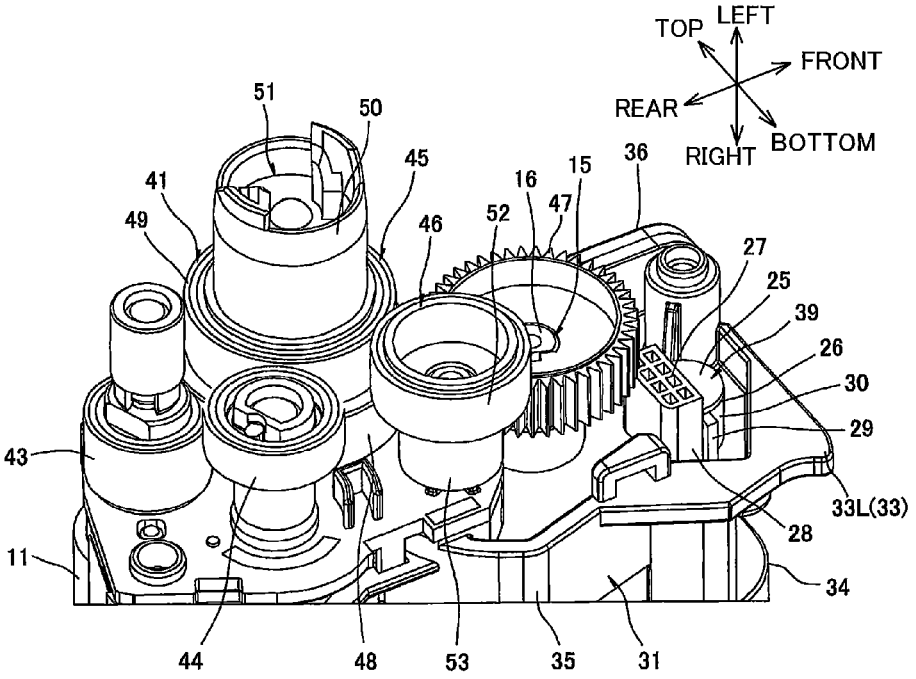
Figure 12B:
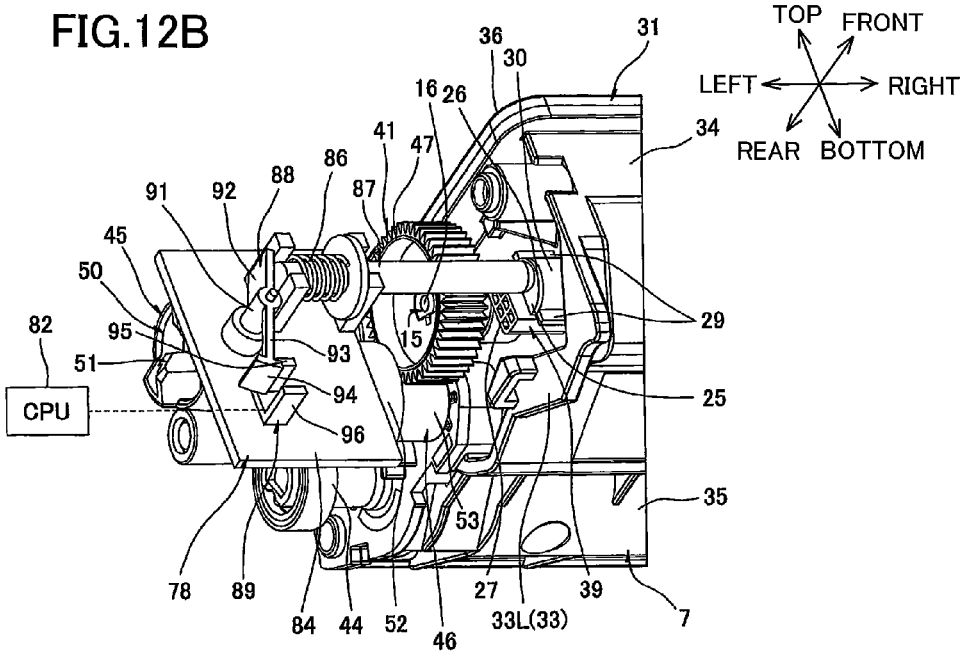

In a case where the toner cap 39 is fitted into the toner cap fitting portion 30 such that the projecting portion 27 is disposed rearward of the fitting portion 25 (see FIG. 12A), the probe 87 is not brought into contact with the projecting portion 27 of the toner cap 39 but is opposed to the fitting portion 25 of the toner cap 39 (see FIG. 12B) when the detection unit 78 is at the cartridge type detection position. In this case, the CPU 82 determines that a predetermined printing times of the developing cartridge 7 is 3,000 sheets printing.

That is, the position of the projecting portion 27 corresponds to information about the types of the developing cartridge 7. More specifically, the case where the projecting portion 27 is disposed frontward of the fitting portion 25 corresponds to information (first information) about the types of the developing cartridge 7 indicating that the predetermined printing times is 6,000 sheets printing, and the case where the projecting portion 27 is disposed rearward of the fitting portion 25 corresponds to information (second information) about the types of the developing cartridge 7 indicating that the predetermined printing times is 3,000 sheets printing.

Thereafter, the CPU 82 counts actual printing times starting from assembly of the unused developing cartridge 7 into the main casing 2, and notifies and displays on an operation panel (not shown) an exchanging timing of the developing cartridge 7 when the counted printing times approaches a predetermined printing times in accordance with the types of the developing cartridge 7.

On the other hand, there is a case where after the unused developing cartridge 7 is assembled, the developing cartridge 7 is again assembled to the main casing 2 after the developing cartridge 7 is detached from the main casing 2, for example, for removing a jammed sheet P. In such a case, the shutter 62 is stopped at the exposed position.

At this time, the user looks at the gear cover 42 of the developing cartridge 7 to confirm that the display portion 73 of the shutter 62 is exposed to the outside through the exposure opening 65. Thus, the user determines that the developing cartridge 7 is an old cartridge (a cartridge in use).

After the used developing cartridge 7 that has once been detached is assembled once again into the main cartridge 2, the probe 87 is not positioned at the retracted position but stays at the advanced position as shown in FIG. 10B when the detection unit 78 is positioned at the new cartridge detection position. Thus, the CPU 82 does not receive the ON signal from the photo-sensor 89.

Accordingly, the CPU 82 determines that the shutter 62 has stayed at the exposed position. Further, the CPU 82 determines that the re-assembled cartridge 7 is an old cartridge.

Then, the CPU 82 continues comparison between the predetermined printing times and the accumulated total number of printing times from the timing at which the CPU 82 determines that the assembled developing cartridge 7 is a new cartridge.

5. Operation for Detecting Remaining Amount of Toner in Developing Cartridge

An operation for detecting a remaining amount of toner in the developing cartridge 7 will be described.

Although not illustrated, after completion of the new cartridge detection operation and the cartridge type detection operation, the detection unit 78 is retracted from an optical path of the detection light emitted from the light emitting element 80.

Then, the detection light enters the toner chamber 14 passing through the fitting portion 25 of the toner cap 39. That is, the fitting portion 25 of the toner cap 39 serves also as a light guiding portion that guides the detection light to the toner chamber 14.

When an amount of the toner in the toner chamber 14 is reduced to allow the detection light to pass through the toner chamber 14, the detection window (not shown) of the right side wall 33R of the cartridge frame 31 and the detection window 59 of the power supply unit 58, and thus, the detection light is received by the light receiving element 81, the light receiving element 81 outputs an ON signal to the CPU 82.

By receiving the ON signal from the light receiving element 81, the CPU 82 determines that the amount of the toner in the toner chamber 14 is reduced.

Also in this case, the CPU 82 notifies and displays on an operation panel (not shown) that an exchanging timing of the developing cartridge 7 is approaching.

6. Operational Advantages (1) According to the developing cartridge 7 and the printer 1, the shutter 62 is irreversibly movable from the covered position (FIG. 9A) to the exposed position (FIG. 9B).

When the detection unit 78 detects the movement of the shutter 62 within a predetermined period of time, the CPU 82 determines that the developing cartridge 7 is unused.

Thus, in a state where the developing cartridge 7 is assembled into the main casing 2, the movement of the shutter 62 allows the detection unit 78 of the main casing 2 to detect the information as to whether the developing cartridge 7 is used or unused.

Further, in a state where the developing cartridge 7 is detached from the main casing 2, the user can easily visually confirm a position of the display portion 73 of the shutter 62.

Thus, the user can easily recognize whether the developing cartridge 7 is used or unused by confirming displacement of the display portion 73 of the shutter 62.

(2) Further, according to the developing cartridge 7 and the printer 1, the developing cartridge 7 can be determined to be unused when the display portion 73 of the shutter 62 is positioned at the exposed position.

(3) Further, according to the developing cartridge 7 and the printer 1, the toner cap 39 can be covered by the shutter 62 before the driving force is inputted to the gear train 41, i.e., when the developing cartridge 7 is unused, as shown in FIG. 9A.

Thus, when the developing cartridge 7 is unused, the toner cap 39 can be protected.

(4) Further, according to the developing cartridge 7 and the printer 1, by positioning the detection unit 78 at the cartridge type detection position after the shutter 62 has been positioned at the exposed position as shown in FIG. 11, the types of the developing cartridge 7 can be detected.

Thus, during the use of the developing cartridge 7, the detection unit 78 can detect the types of the developing cartridge 7 at an arbitrary timing.

(5) Further, according to the developing cartridge 7 and the printer 1, the fitting portion 25 of the toner cap 39 serves also as a light guiding portion for guiding the detection light emitted from the light emitting element 80 of the empty sensor unit 79 to the toner chamber 14 as shown in FIGS. 2A and 3.

Thus, the empty sensor unit 79 can detect the remaining amount of toner in the toner chamber 14.

(6) Further, according to the developing cartridge 7 and the printer 1, the shutter 62 has the slider 71 provided with the toothed portion 74 to which the driving force is transmittable and the untoothed portion 75 prohibiting transmission of the driving force, as shown in FIG. 7.

Thus, the shutter 62 can be stopped reliably after being moved with a predetermined moving amount. As a result, with a simple configuration, the shutter 62 can be reliably irreversibly moved.

7. Modifications (1) In the above-described embodiment, the remaining amount of toner in the toner chamber 14 is detected by means of the empty sensor unit 79. Alternatively, however, a position of the agitation blades 17 of the agitator 15 can be determined by means of the empty sensor unit 79. In this case, it is assumed that a toner level is below the toner filling port 38 and the detection light emitted from the light emitting element 80 is always received by the light receiving element 81.

When the agitation blades 17 extending from the agitator shaft 16 confront the toner filling port 38 during rotation of the agitator 15, the detection light is blocked by the agitation blades 17. As a result, output of the ON signal from the light receiving element 81 to the CPU 82 is interrupted.

Then, the CPU 82 determines that the agitation blades 17 is in confrontation with the toner filling port 38 due to interruption of the ON signal from the light receiving element 81.

According to the modification, the position of the agitation blades 17 of the agitator 15 can be detected by means of the empty sensor unit 79.

Thus, rotation of the agitator 15 can be controlled so as to stop the agitation blades 17 at a desired position.

According to this modification, operations and effects similar to those of the above-described embodiment can also be obtained.

(2) Further, in the above-described embodiment, the empty sensor unit 79 includes the light emitting element 80 and the light receiving element 81. The light emitting element 80 is positioned at a left side of the developing cartridge 7, and the light receiving element 81 is positioned at a right side of the developing cartridge 7. The detection light from the light emitting element 80 is received by the light receiving element 81.

Alternatively, however, a configuration may be possible in which both the light emitting element 80 and the light receiving element 81 are positioned at a left side of the developing cartridge 7 and a reflection plate is positioned at a right side of the developing cartridge 7 to allow the detection light from the light emitting element 80 to be reflected by the reflection plate and received by the light receiving element 81.

(3) In the above-described embodiment, the shutter 62 is positioned at the covered position in a state where the developing cartridge 7 is unused, and the shutter 62 is moved from the covered position to the exposed position in the new cartridge detection operation. Alternatively, however, a configuration may be possible in which the shutter 62 is positioned at the exposed position in a state where the developing cartridge 7 is unused and the shutter 62 is moved from the exposed position to the covered position in the new cartridge detection operation.

Note that, in this modification, the cartridge type detecting operation and the toner amount detecting operation may be performed by methods different from those described in the above embodiment and known to those skilled in the art.

According to this modification, the toner cap 39 can be covered after input of the driving force to the gear train 41, i.e., while the developing cartridge 7 is being used.

Thus, the developing cartridge 7 can be prevented from being filled with non-regular toner during or after use of the developing cartridge 7.

According to this modification, operations and effects similar to those of the above-described embodiment can also be obtained.

(4) Further, in the above-described embodiment, the toner cap 39 includes the projecting portion 27. The types of the developing cartridge 7 can be detected based on whether or not the probe 87 of the detection unit 78 abuts on the projecting portion 27.

Figure 13A:
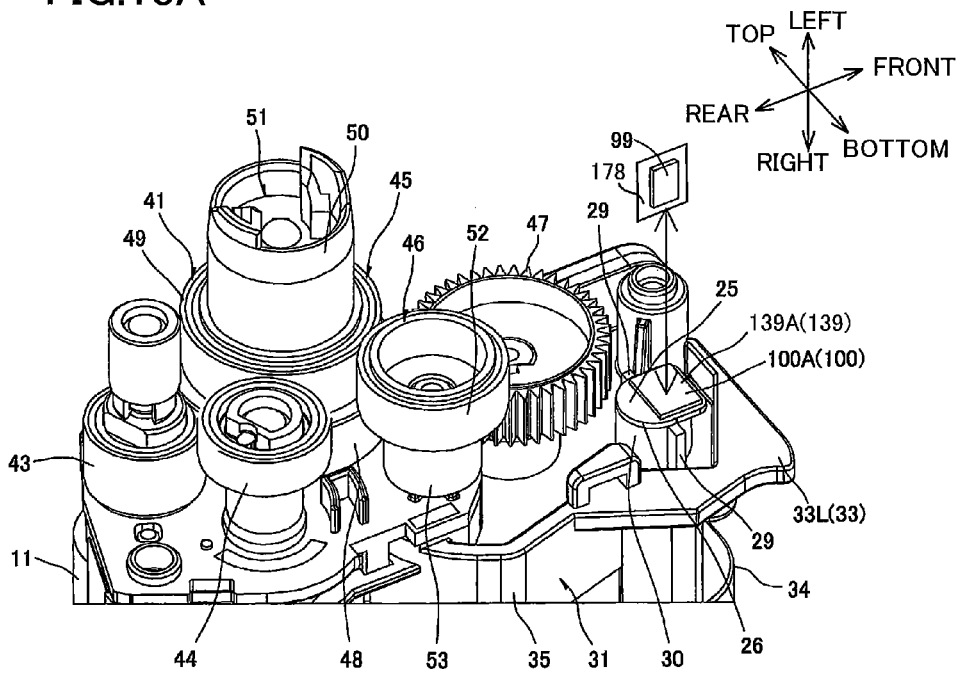
Figure 13B:
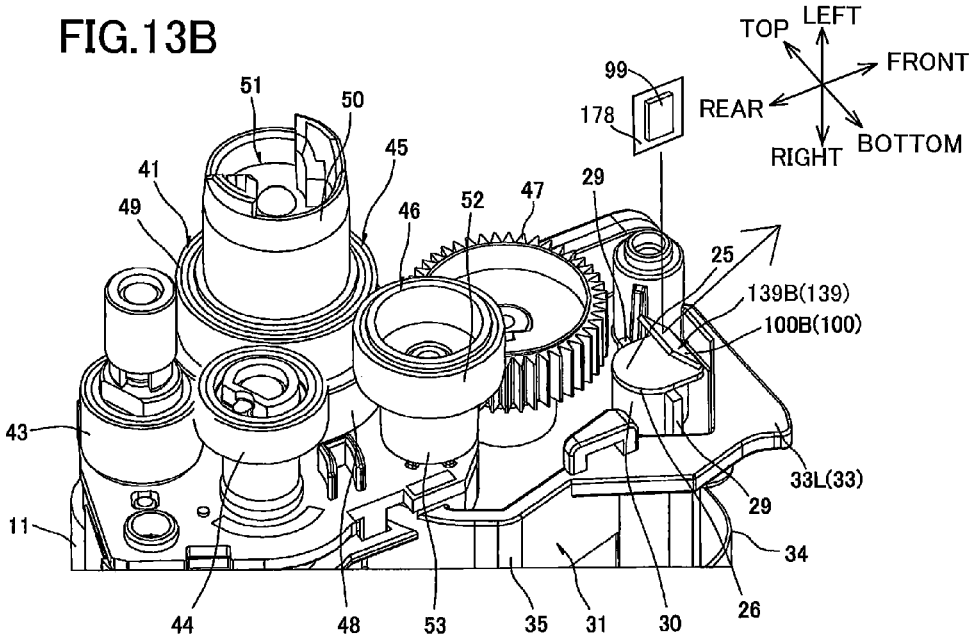

However, in this modification, as shown in FIGS. 13A and 13B, a toner cap 139 includes a reflection plate 100. Further, a detection unit 178 includes a photo-sensor 99 including a light emitting element and a light receiving element.

In this configuration, a reflected light of a detection light emitted from the light emitting element of the photo-sensor 99 is detected by the light receiving element of the photo-sensor 99, whereby the types of the developing cartridge 7 can be detected.

For example, as shown in FIG. 13A, the toner cap 139A includes a reflection plate 100A extending in the frontward/rearward direction and in the vertical direction. The toner cap 139A corresponds to information (first information) about the type of the developing cartridge 7 indicating that a predetermined printing times is 6,000 sheets printing. Further, as shown in FIG. 13B, the toner cap 139B includes a reflection plate 100B diagonally inclined rightward toward a front side of the reflection plate 100B. The toner cap 139B corresponds to information (second information) about the type of the developing cartridge 7 indicating that a predetermined printing times is 3,000 sheets printing.

Then, in a case where a reflected light of the detection light emitted from the light emitting element of the photo-sensor 99 is detected by the light receiving element of the photo-sensor 99 as shown in FIG. 13A, the CPU 82 determines that a predetermined printing times of the developing cartridge 7 is 6,000 sheets printing.

On the other hand, in a case where a reflected light of the detection light emitted from the light emitting element of the photo-sensor 99 is not detected by the light receiving element of the photo-sensor 99 as shown in FIG. 13B, the CPU 82 determines that a predetermined printing times of the developing cartridge 7 is 3,000 sheets printing.

According to this modification, operations and effects similar to those of the above-described embodiment can also be obtained.

(5) Further, in the above-described embodiment, the detection unit 78 is movable to the new cartridge detection position and to the cartridge type detection position. Alternatively, however, appropriate arrangement of the slide member 84, the probe 87, the actuator 88, and the photo-sensor 89 allows detection of whether the developing cartridge 7 is used or unused and detection of the type of the developing cartridge 7 without moving the detection unit 78.

While the present invention has been described in detail with reference to the embodiments thereof, it would be apparent to those skilled in the art that various changes and modifications may be made therein without departing from the spirit of the present invention.

What is claimed is:

1. A cartridge comprising:

a frame defining an internal space for accommodating therein developing agent, the frame being formed with a filling port for filling the internal space with the developing agent therethrough;

a rotation body having a rotation axis extending in a predetermined direction, the rotation body being provided at the frame and rotatable about the rotation axis relative to the frame;

a driving force transmission unit provided at the frame and configured to transmit an external driving force to the rotation body;

a closing member configured to close the filling port; and a moving member configured to be irreversibly moved to one of a covered position and an exposed position by the external driving force transmitted through the driving force transmission unit, the moving member covering at least a portion of the closing member when the moving member is at the covered position, the moving member exposing the closing member when the moving member is at the exposed position, the exposed position providing an exposing degree greater than that at the covered position.

2. The cartridge as claimed in claim 1, wherein one of the covered position and the exposed position indicates that the cartridge is a new cartridge.

3. The cartridge as claimed in claim 1, wherein the moving member is irreversibly moved from the covered position to the exposed position.

4. The cartridge as claimed in claim 1, wherein the moving member is irreversibly moved from the exposed position to the covered position.

5. The cartridge as claimed in claim 1, wherein the closing member includes a detected portion configured to be detected by an external detection unit;

wherein the detected portion has information relating to types of the cartridge; and wherein the moving member covers the detected portion when the moving member is at the covered position.

6. The cartridge as claimed in claim 5, wherein the detected portion comprises a projection detected by the external detection unit, the projection being indicative of one of the types of the cartridge.

7. The cartridge as claimed in claim 5, wherein the detected portion comprises a reflection plate configured to reflect detection light emitted from the external detection unit, the reflection plate being indicative of one of the types of the cartridge.

8. The cartridge as claimed in claim 5, wherein the detected portion comprises a light guiding portion configured to guide detection light emitted from the external detection unit into the internal space defined by the frame.

9. The cartridge as claimed in claim 8, wherein the rotation body is an agitation member configured to agitate developing agent.

10. The cartridge as claimed in claim 1, wherein the moving member includes a partially toothless gear comprising a toothed portion to which the external driving force is transmittable, and a toothless portion prohibiting transmission of the external driving force.

11. An image forming apparatus comprising:

a main casing; and a cartridge detachable from and attachable to the main casing, the cartridge comprising:

a frame defining an internal space for accommodating therein developing agent, the frame being formed with a filling port for filling the internal space with the developing agent therethrough;

a rotation body having a rotation axis extending in a predetermined direction, the rotation body being provided at the frame and rotatable about the rotation axis relative to the frame;

a driving force transmission unit provided at the frame and configured to transmit a driving force from the main casing to the rotation body;

a closing member configured to close the filling port; and a moving member configured to be irreversibly moved to one of a covered position and an exposed position by the driving force transmitted through the driving force transmission unit, the moving member covering at least a portion of the closing member when the moving member is at the covered position, the moving member exposing the closing member when the moving member is at the exposed position, the exposed position providing an exposing degree greater than that at the covered position, the main casing comprising:

a detection unit configured to detect a movement of the moving member; and a judgment unit configured to judge a condition of the cartridge based on a detection of the detection unit.

12. The image forming apparatus as claimed in claim 11, wherein one of the covered position and the exposed position indicates that the cartridge is a new cartridge.

13. The image forming apparatus as claimed in claim 11, wherein the moving member is irreversibly moved from the covered position to the exposed position.

14. The image forming apparatus as claimed in claim 11, wherein the moving member is irreversibly moved from the exposed position to the covered position.

15. The image forming apparatus as claimed in claim 11, wherein the judgment unit makes a judgment that the cartridge attached to the main casing is a new cartridge if the detection unit detects the movement of the moving member within a predetermined period of time.

16. The image forming apparatus as claimed in claim 11, wherein the closing member includes a detected portion configured to be detected by the detection unit;

wherein the detected portion has information relating to types of the cartridge; and wherein the moving member covers the detected portion when the moving member is at the covered position.

17. The image forming apparatus as claimed in claim 16, wherein the detected portion comprises a projection detected by the detection unit, the projection being indicative of one of the types of the cartridge.

18. The image forming apparatus as claimed in claim 16, wherein the detection unit includes a photo-sensor configured to emit a detection light and to receive the detection light; and wherein the detected portion comprises a reflection plate configured to reflect the detection light emitted from the photo-sensor, the reflection plate being indicative of one of the types of the cartridge.

19. The image forming apparatus as claimed in claim 16, wherein the detection unit is configured to emit a detection light; and wherein the detected portion comprises a light guiding portion configured to guide the detection light into the frame.

20. The image forming apparatus as claimed in claim 19, wherein the rotation body is an agitation member configured to agitate developing agent.

21. The image forming apparatus as claimed in claim 11, wherein the moving member includes a partially toothless gear comprising a toothed portion to which the driving force is transmittable, and a toothless portion prohibiting transmission of the driving force.

* * * * *